US010370847B2

(12) United States Patent
Caffaratti Giro

(10) Patent No.: US 10,370,847 B2
(45) Date of Patent: Aug. 6, 2019

(54) MODULAR SOUND-PROOFED CABIN

(71) Applicant: Dario Alejandro Caffaratti Giro, Madrid (ES)

(72) Inventor: Dario Alejandro Caffaratti Giro, Madrid (ES)

( * ) Notice: Subject to any disclaimer, the term of this patent is extended or adjusted under 35 U.S.C. 154(b) by 0 days.

(21) Appl. No.: 15/537,976

(22) PCT Filed: Nov. 17, 2015

(86) PCT No.: PCT/ES2015/070819

§ 371 (c)(1),
(2) Date: Jun. 20, 2017

(87) PCT Pub. No.: WO2016/102723

PCT Pub. Date: Jun. 30, 2016

(65) Prior Publication Data

US 2017/0356182 A1 Dec. 14, 2017

(30) Foreign Application Priority Data

Dec. 22, 2014 (ES) ..... 201431658 U

(51) Int. Cl.

| | |
|---|---|
| ***E04B 1/82*** | (2006.01) |
| ***E04H 1/12*** | (2006.01) |
| ***E04B 1/343*** | (2006.01) |

(52) U.S. Cl.

CPC ..... *E04B 1/8218* (2013.01); *E04H 1/12* (2013.01); *E04B 1/34384* (2013.01)

(58) Field of Classification Search

CPC ..... E04B 1/8218; E04B 1/34384; E04B 1/82; E04H 1/12

See application file for complete search history.

(56) References Cited

U.S. PATENT DOCUMENTS 2,915,791 A * 12/1959 Hauf ..... E04B 1/8218 52/214
2,927,665 A * 3/1960 Hauf ..... E04B 1/6803 181/290

(Continued)

FOREIGN PATENT DOCUMENTS

| | | |
|---|---|---|
| EP | 2762763 | 6/2014 |
| GB | 1296747 | 11/1972 |

(Continued)

OTHER PUBLICATIONS

EPO Search Report and Written Opinion for related Application No. 15872005.2 (7 pages) (Year: 2018).*

*Primary Examiner* — Rodney Mintz
(74) *Attorney, Agent, or Firm* — Hoffmann & Baron, LLP

(57) ABSTRACT

Modular soundproof cabin (1), of the type comprising a perimeter wall (2) having perimeter panels (21, 22, 23, 24, 25), an upper ceiling (3) having ceiling panels (3*a*) and a lower floor (4) having floor panels (4*a*), where the panels (3*a*, 4*a*, 21, 22, 23, 24, 25) have acoustic insulation properties, where the perimeter panels (21, 22, 23, 24, 25) comprise frames (5) on their inner side, comprising intermediate horizontal struts (6) provided between horizontal lines (90, 91) of perimeter panels (21, 22, 23, 24, 25), and end horizontal struts (7) provided between the perimeter wall (2) and the upper ceiling (3) and lower floor (4); comprising mechanical fixation means, at least, between the frames (5) and the horizontal struts (6, 7), and between the ceiling panels (3*a*) and the floor panels (4*a*) and the end horizontal struts (7).

21 Claims, 10 Drawing Sheets

(56) References Cited

U.S. PATENT DOCUMENTS

| | | | | | |
|---|---|---|---|---|---|
| 3,517,468 | A * | 6/1970 | Woods | E04B 1/8218 | 52/144 |
| 3,538,662 | A * | 11/1970 | Van Tuyl | E04B 1/34315 | 52/262 |
| 3,790,696 | A * | 2/1974 | Lindgren | H05K 9/0001 | 174/373 |
| 4,120,376 | A * | 10/1978 | Palmer | E04B 1/8218 | 181/204 |
| 4,258,511 | A | 3/1981 | Strain | | |
| 5,210,984 | A * | 5/1993 | Eckel | E04B 1/8218 | 52/265 |
| 5,239,792 | A * | 8/1993 | Avni | E04B 1/8218 | 52/171.3 |
| 5,386,788 | A * | 2/1995 | Linker | E05G 1/024 | 109/58 |
| 5,533,305 | A * | 7/1996 | Bielecki | A61L 2/022 | 297/343 |
| 7,076,922 | B1 | 7/2006 | Parres | | |
| 8,556,028 | B1 * | 10/2013 | Nason | E06B 5/20 | 181/284 |
| 9,732,548 | B1 * | 8/2017 | Halon | E04H 9/06 | |
| 2008/0098663 | A1 * | 5/2008 | Seel | E04B 1/8218 | 52/36.1 |
| 2009/0223161 | A1 * | 9/2009 | Segall | E04B 1/34315 | 52/588.1 |
| 2013/0264146 | A1 * | 10/2013 | Nason | E06B 5/20 | 181/290 |
| 2017/0284084 | A1 * | 10/2017 | Carapinha | E04B 1/8218 | |

FOREIGN PATENT DOCUMENTS

| | | | | | |
|---|---|---|---|---|---|
| GB | 1495273 | A * | 12/1977 | E04B 1/8218 | |
| GB | 2318596 | A * | 4/1998 | E04B 2/707 | |
| WO | WO-2005014947 | A1 * | 2/2005 | E04B 2/707 | |

* cited by examiner

MODULAR SOUND-PROOFED CABIN

CROSS REFERENCE TO RELATED APPLICATIONS

The present application is a United States national stage of PCT Application No. PCT/ES2015/070819, filed Nov. 17, 2015, which in turn claims the benefit of priority to Spanish Application Serial No. U 201431658, filed Dec. 22, 2014. Applicant claims the benefits of 35 U.S.C. § 120 to the PCT application and priority under 35 U.S.C. § 119 to the Spanish application, and the entire disclosures of both applications are herein incorporated by reference in their entireties.

OBJECT OF THE INVENTION

The present invention refers to a modular soundproof cabin, which is usable for generating a portable and easy to assemble soundproof space.

PRIOR ART

Several means for soundproofing or controlling the sound for different applications are known. For example, an audiometric cabin used in the sanitary field for studying the hearing capabilities of a patient and a soundproof telephone cabin, also designed for providing sound insulation in a telephone communication, are known.

On the other hand, in connection with the soundproofing of larger spaces, currently large halls are soundproofed by modifying the construction materials such that sound insulating materials are provided. However, this system requires having a specialized knowledge, it is permanent and very costly, and therefore the soundproof feature can only be enjoyed in such reconstructed place.

Furthermore, all these systems are disadvantageous in that they are designed for very specific uses, and they require specialized personnel for carrying out the assembly operations and, where possible, also for the disassembly operations.

In addition, modular soundproof cabins comprising a plurality of panels coupled ones with the others, allowing for a very economic transport and in situ assembly, are also known. In these cabins, coupling means between cabins comprise exclusively dovetails and mutual support systems, where the dovetails comprise intermediate independent parts. These coupling means result in a fast assembly however showing a number of drawbacks, such as the final unit not being very solid, due to lack of fixation elements between panels, lack of modularity in certain elements—such as the access door—entailing a large size thereof, or the presence of possible acoustic bridges at the junctions between panels, which are only broken by the dovetails but which lack absorbing elements, and therefore they are not completely reduced and thus worsen the sound insulating properties of the thus built wall.

Furthermore, since there are no fixation means and the connection between panels is carried out only by means of abutting the edges of the panels and providing deep dovetails, the maximum size of the perimeter panels is limited in height provided that the dovetails are not very deep, this feature being the weak point of the connection, and thus if a properly solid assembly is required vertical walls having several panel lines, up to four or five, are needed, this increasing the part count, as well as the complexity of the assembly works.

Similarly, the ceiling in these cabins cannot have very large dimensions (span), since their pieces must be supported by the perimeter of the cabin, their size being thus limited.

Further, since the supporting capacity of the panels is implemented in the soundproof layers themselves, they must necessarily be larger, this entailing also a larger weight.

DESCRIPTION OF THE INVENTION

The modular soundproof cabin of the invention has a configuration solving the abovementioned drawbacks. It is of the type comprising a perimeter wall having perimeter panels, an upper ceiling having ceiling panels and a lower floor having floor panels, the panels having soundproof properties, and where the panels are modularly coupled therebetween, thus allowing for an easy transport, since the size of the modules is smaller with respect to the assembled cabin, and an easy assembly, and even disassembly.

According to the invention, the perimeter panels comprise frames on their inner side by means of which the cabin will be assembled. To this end, it further comprises intermediate horizontal struts provided between horizontal lines of perimeter panels, and end horizontal struts, provided between the perimeter wall and the upper ceiling and lower floor. Further, it also comprises mechanical fixation means, at least between the frames and the horizontal struts, and between the ceiling panels and the floor panels and the end horizontal struts. These mechanical fixations, understood as those withstanding simultaneous traction and shear stresses, and typically comprising screws, allow for a solid and resistant construction and also for an easy disassembly.

DESCRIPTION OF A PRACTICAL EMBODIMENT OF THE INVENTION

Figure 1:
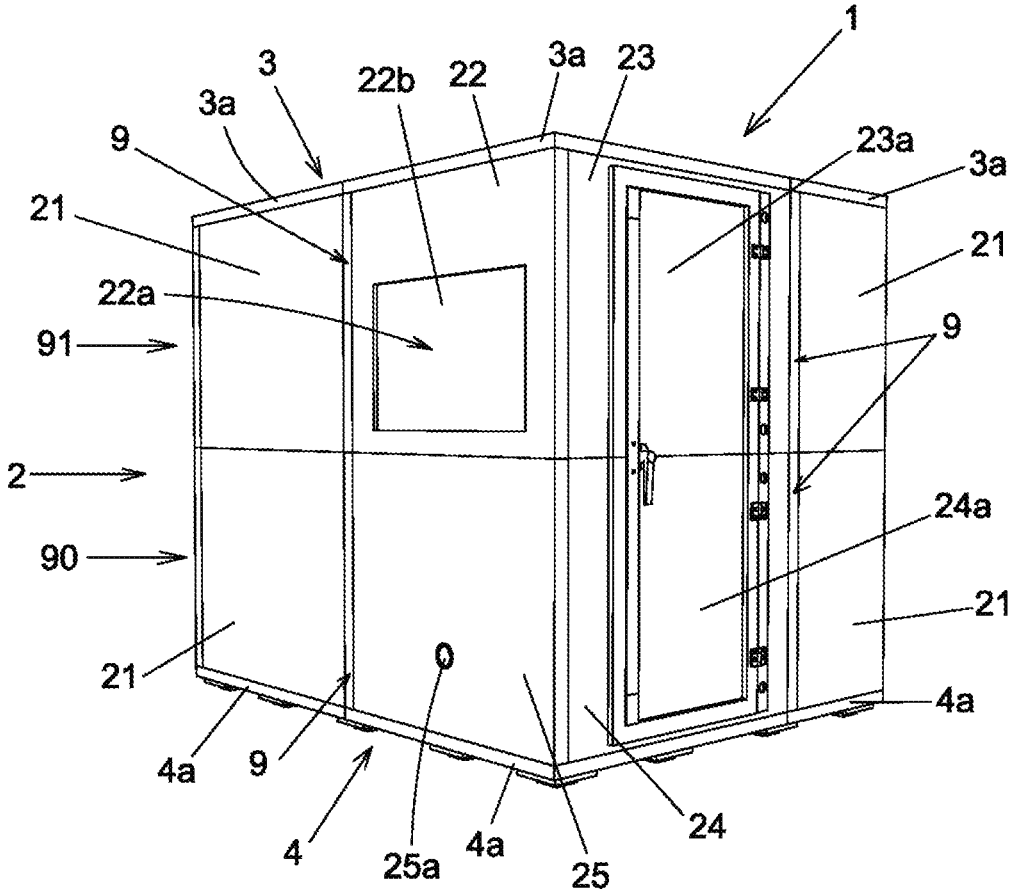
FIG. 1 shows an exterior view of a variation of the cabin of the invention.

The modular soundproof cabin (1) disclosed is of the type comprising a perimeter wall (2) having perimeter panels (21, 22, 23, 24, 25), an upper ceiling (3) having ceiling panels (3*a*) and a lower floor (4) having floor panels (4*a*), the panels (3*a*, 4*a*, 21, 22, 23, 24, 25) having acoustic insulation properties.

According to the invention, the perimeter panels (21, 22, 23, 24, 25) comprise frames (5) on their inner side (see FIG. 2), the cabin (1) further comprising intermediate horizontal struts (6) provided between two lines (90, 91) of perimeter panels (21, 22, 23, 24, 25) for their connection (see FIGS. 2, 3 y 7), and end horizontal struts (7) (see FIGS. 6 and 7) provided between the perimeter wall (2) and the upper ceiling (3) and lower floor (4) in order to also connecting them, mechanical fixation means being provided therefor at least between the frames (5) and the horizontal struts (6, 7), and between the ceiling panels (3*a*) and the floor panels (4*a*) and the end horizontal frames (7).

The frames (5) in this example of the invention are shaped as closed frames, but they could adopt any other shape capable of carrying out the intended function. Similarly, in this example embodiment a lower line (90) and an upper line (91) of perimeter panels (21, 22, 23, 24, 25) (see FIG. 1) are provided, without intermediate lines, although a higher number of horizontal lines could be provided.

The horizontal struts (6, 7) are divided into segments (6*a*, 7*a*) (see FIGS. 3, 4 and 8), each segment (6*a*, 7*a*) overlapping, at least, a union between adjacent perimeter panels horizontally such that they are laterally connected, where these segments (6*a*, 7*a*) in combination with the frames (5), which are connected, provided perimeter structural connection to the cabin (1). The segments (6*a*, 7*a*), as well as the perimeter panels (21, 22, 23, 24, 25) have different modular dimensions for configuring cabins (1) having different dimensions. Furthermore, the segments (6*a*, 7*a*) comprise end dovetails (8) for improving their end contact.

Figure 3:
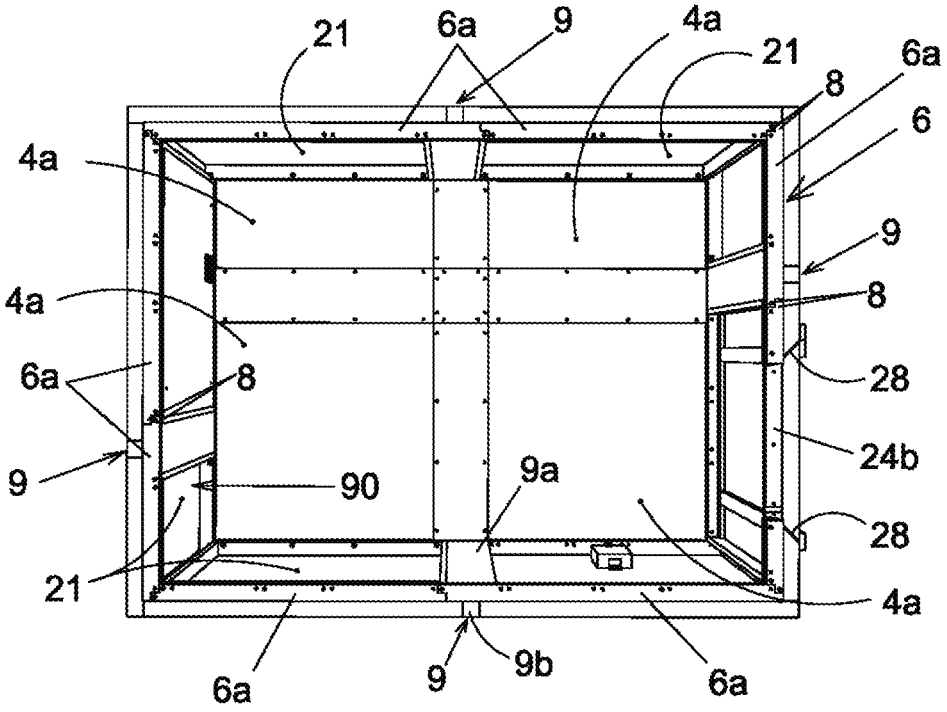
FIG. 3 shows an upper view of a partial assembly of the cabin of the invention according to the variation shown in FIG. 1, comprising the lower line.
Figure 4:
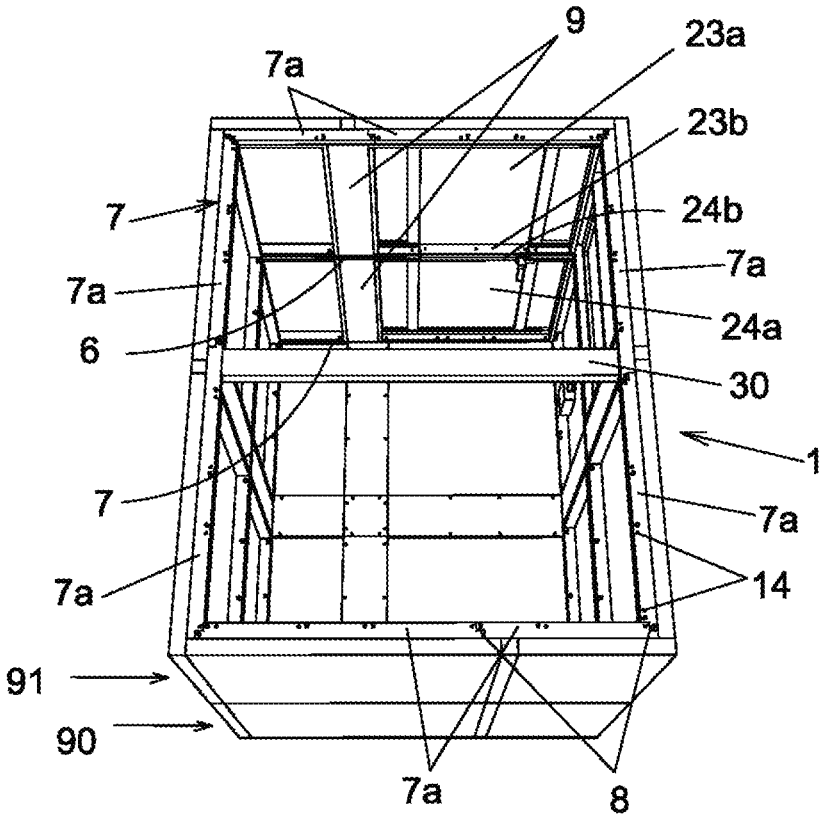
FIG. 4 shows an upper view of a partial assembly of the cabin of the invention according to the variation shown in FIG. 1, comprising a lower line and an upper line, where the upper ceiling has not yet being installed.

The cabin (1) may additionally comprise vertical struts (9) for being laterally inserted straight between perimeter panels (21, 22, 23, 24, 25), as seen in the figures. Said vertical struts (9) comprise (see FIG. 6), at least, a solid inner square portion (9*a*) intended to abut the frames (5) of the adjacent perimeter panels. Furthermore, they can additionally comprise an outer soundproof portion (9*b*) which is recessed with respect to the lateral edges of the square portion (9*a*), and it will be inserted between the adjacent panels, which is the embodiment disclosed in the present exemplary preferred embodiment, as seen in detail in FIGS. 3 and 6. Specifically, FIG. 3 shows how the segments (6*a*) of the intermediate horizontal strut (6) overlap several perimeter panels adjacent the struts (9) inserted therebetween.

Figure 6:
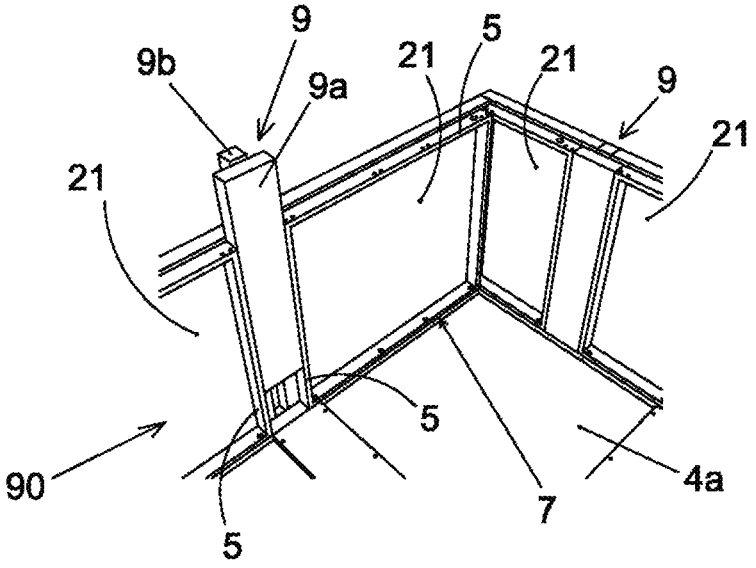
FIG. 6 shows a detail of the assembly of a vertical strut.
Figure 7:
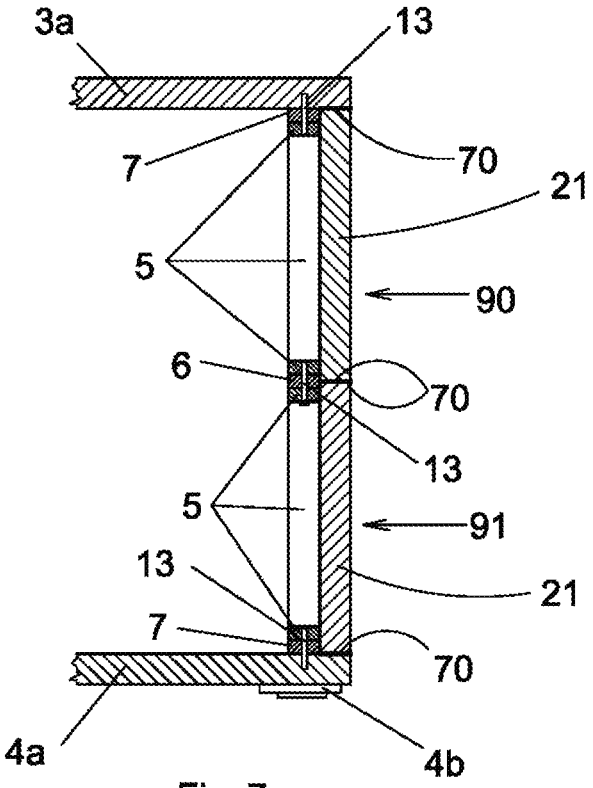
FIG. 7 shows a vertical partial section in a zone with simple panels of the cabin of the invention.

The perimeter panels (21, 22, 23, 24, 25) project from the frames (5) a length enough for overlapping the horizontal struts (6, 7) and the solid inner square portion (9*a*) of the vertical struts (9), in order to ensure the continuity of the acoustic insulation. With the same object, the outer soundproof portion (9*b*) projects up and down from the inner square portion (9*a*) a length enough for overlapping the horizontal struts (6, 7). FIG. 6 shows these projections of the perimeter panels (21) and of the outer soundproof portions (9*b*) in the upper zone of the lower line (90), thus creating an overlap covering half the thickness of the intermediate horizontal strut (6) once installed, while the remaining half is covered by the lower projections of the equivalent elements in the upper line, not represented in this figure. The end struts (7), however, are completely overlapped by the projections of the perimeter panels. This is seen in the detail of FIG. 7.

Figure 8:
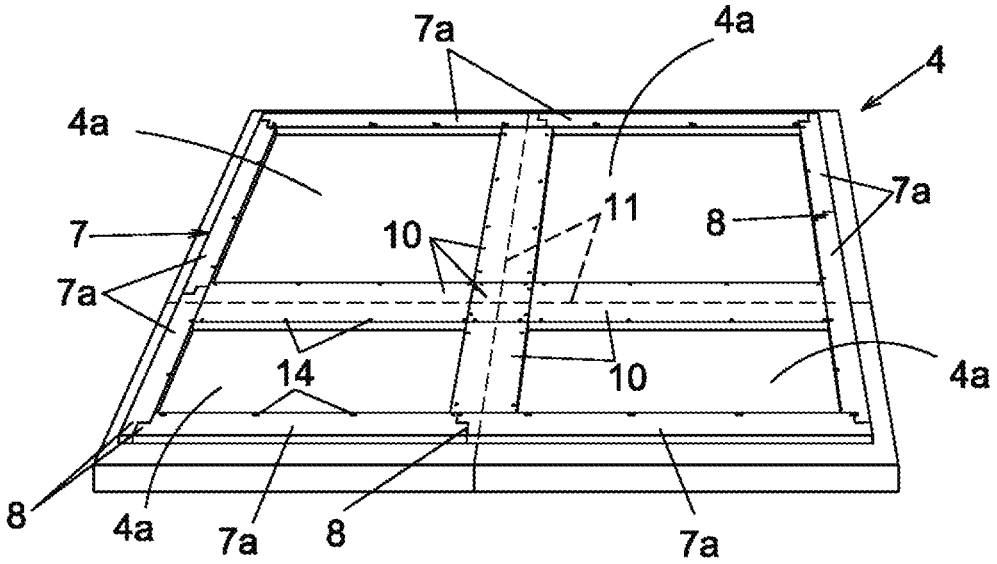
FIG. 8 shows an upper view of the lower floor of the cabin of the invention.
Figure 9:
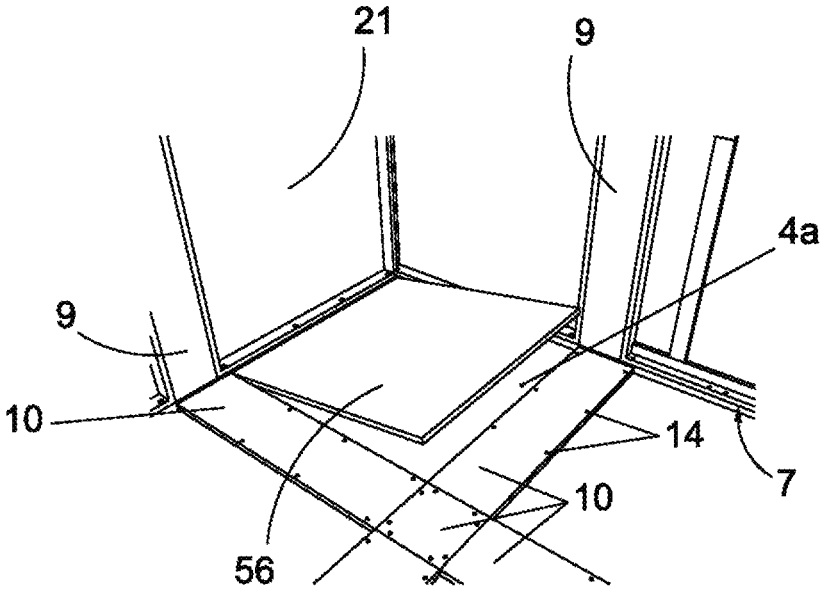
FIG. 9 shows a detail of the placement of parquet flooring parts on the lower floor of the cabin of the invention.
Figure 16:
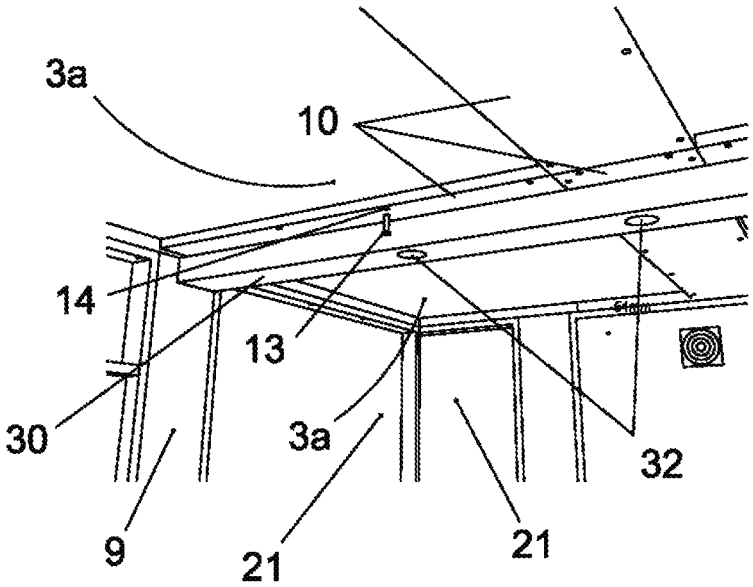
FIG. 16 shows a lower view of the upper resistant beam and the lighting elements.

In order to assemble the upper ceiling (3) and lower floor (4), when they comprise several panels (3*a*, 4*a*), the invention provides intermediate connectors (10) between them. FIG. 8 shows said intermediate connectors (10) for a lower floor (4), and they are shown in FIG. 16 for the panels (3*a*) of the upper ceiling (3). Said intermediate connectors (10) comprise plates overlapping the junctions (11) respectively between adjacent ceiling panels (3*a*) or floor panels (4*a*), and they comprise mechanical fixation means with said panels (3*a*, 4*a*); said intermediate connectors (10) being provided through the inside of the end horizontal struts (7) and having a similar thickness, as seen in FIG. 8. In the gaps configured between the lower end horizontal strut (7) and the intermediate connectors (10), parts (56) of parquet flooring made of an absorbing and resistant material can be provided, as seen in FIG. 9.

The perimeter panels comprise (see FIG. 1) simple perimeter panels (21), window perimeter panels (22), door perimeter panels (23, 24), and/or ventilation perimeter panels (25), where the cabin (1) may be configured modularly by means of a different assembly of these panels, which may include at least one, none, or several of them, as well as the rest of parts of the cabin (1).

Figure 2:
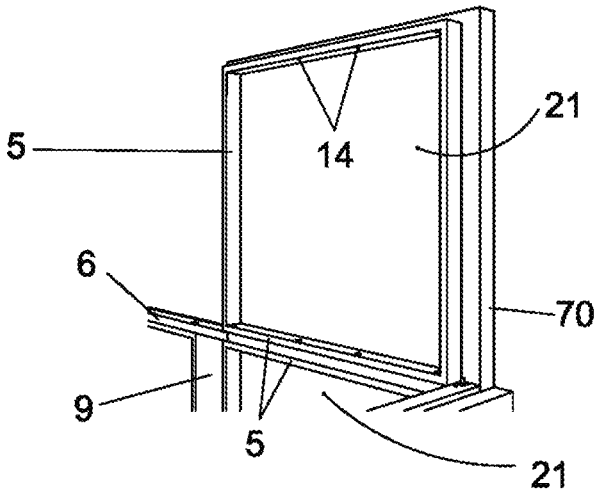
FIG. 2 shows a detailed view of a simple perimeter panel of the cabin of the invention.

Each simple perimeter panel (21) comprises a closed vertical square configuration, as seen in FIG. 2, while each window perimeter panel (22) (see FIG. 1) comprises a hole (22*a*) provided with an acoustic insulating glass (22*b*), for example, at least a laminate glass comprising several layers of glass with elastic layers between them.

Figure 5:
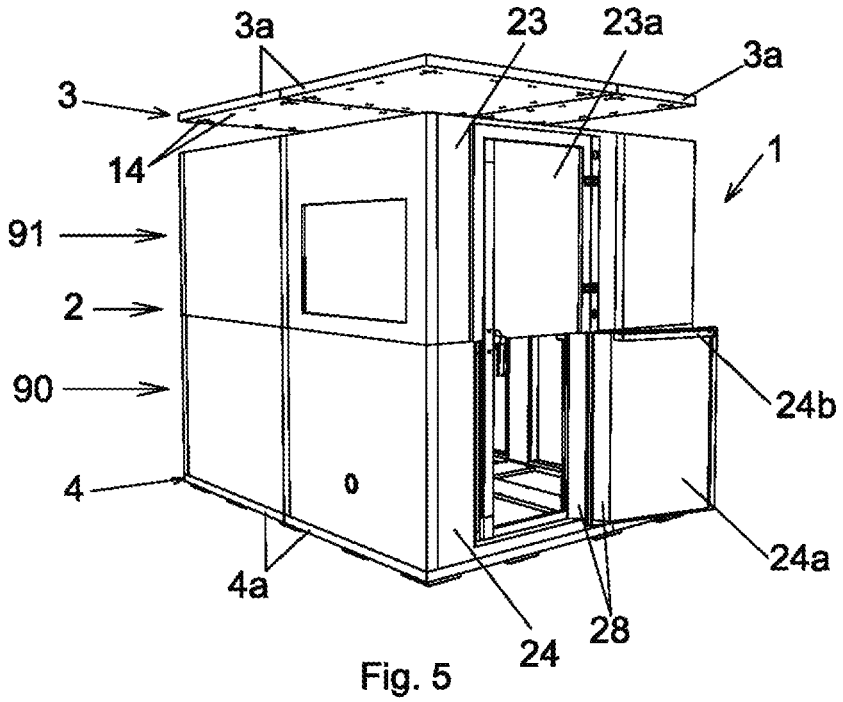
FIG. 5 shows an exterior view of the cabin of the invention shown in FIG. 1, where the placement of the upper ceiling panels and the door configuration in two panels, upper and lower panel, are seen.

The door perimeter panels (23, 24) comprise an upper door panel (23) and a lower door panel (24) (see FIGS. 1 and 5), each of them comprising a folding sector (23*a*, 24*a*) hinged at one of its sides to the rest of the respective panel (23, 24), and comprising mechanical fixation means (23*a*, 23*b*) between each folding sections, which in this example of the invention are implemented between adjacent flanges (23*b*, 24*b*) (see FIG. 4) of both folding sectors (23*a*, 24*a*). Further, the overlapping of the folding sectors (23*a*, 24*a*) with the rest of the respective panel (23, 24) ideally takes place by means of oblique lateral edges (28) (see FIGS. 3 and 5), in order to increase the contact surface between them and minimizing acoustic bridges. Furthermore, as disclosed above, all perimeter panels (21, 22, 23, 24, 25) always comprise the frame (5) on their inner side.

Figure 10:
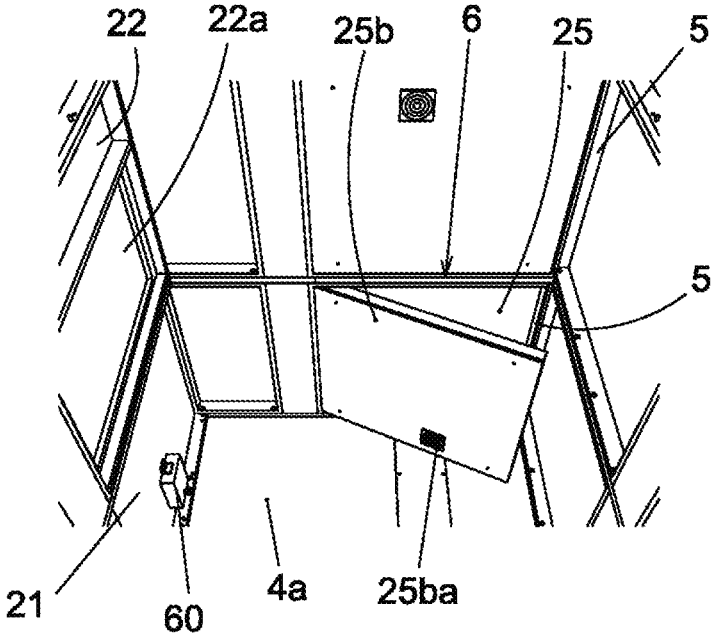
FIG. 10 shows an interior detail of a perimeter ventilation panel.
Figure 11:
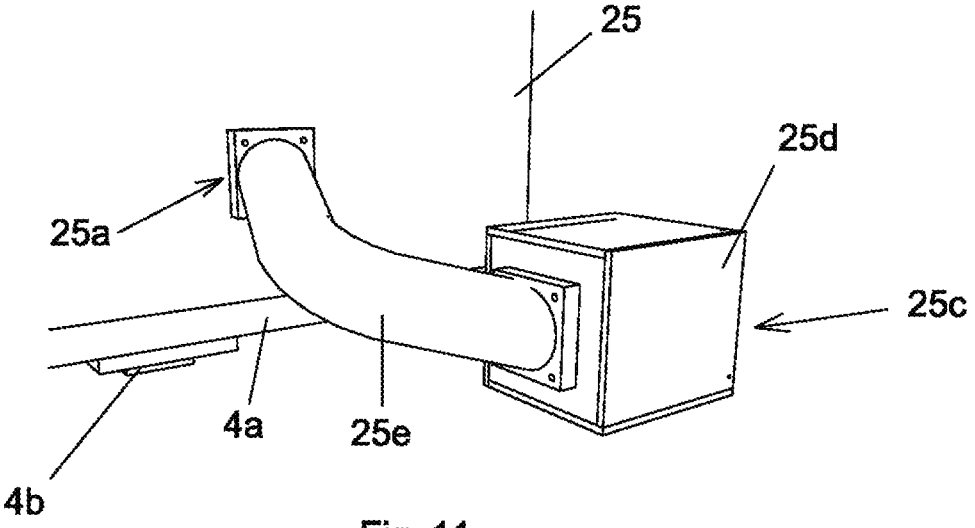
FIG. 11 shows an air blower for ventilating the cabin of the invention.

The ventilation perimeter panels (25) comprise a ventilation through hole (25*a*) (see FIG. 1) and a silencer box (25*b*) (see FIG. 10). Said silencer box (25*b*) is preferably adapted for being inserted in the frame (5) of the respective ventilation perimeter panel (25). This silencer box (25*b*) ideally comprises a first terminal, not represented, connected to the hole (25*a*) and a second free terminal (25*ba*) connected to the interior of the cabin, such that it can be connected at the outside of the hole (25*a*) to an air blower (25*c*) through a soundproof duct (25*e*) (see FIG. 11).

Said air blower (25*c*) may comprise a soundproof cover (25*d*). Specifically, the preferred solution for the ventilation of a generic cabin (1) would be the provision of two ventilation perimeter panels (25), one of which would be connected to the air blower (25*c*) for blowing or extracting air to or from the inside of the cabin (1), while the other could remain without any connection to any blower in order to allow for a compensation air flow generated by underpressure or overpressure.

On the other hand, the ceiling panels (3*a*) and the floor panels (4*a*) comprise a closed horizontal square configuration, in this case without a frame.

Figure 12:
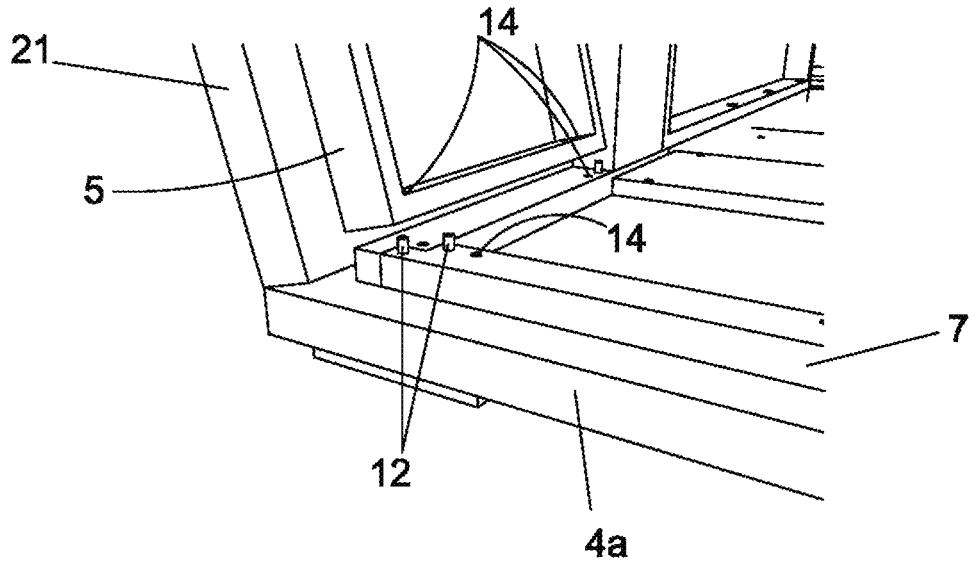
FIG. 12 shows an assembly detail of a perimeter panel on the lower floor.
Figure 13:
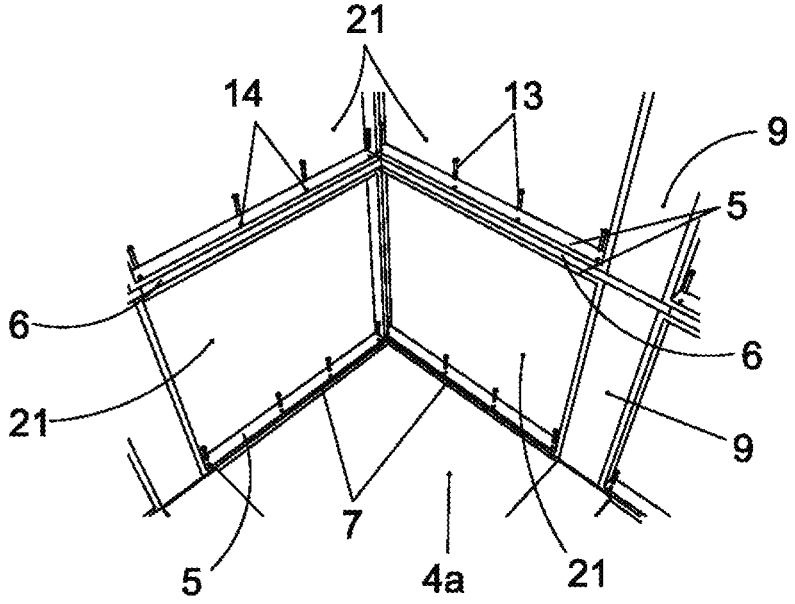
FIG. 13 shows a detail of the union between lines of perimeter panels.
Figure 14:
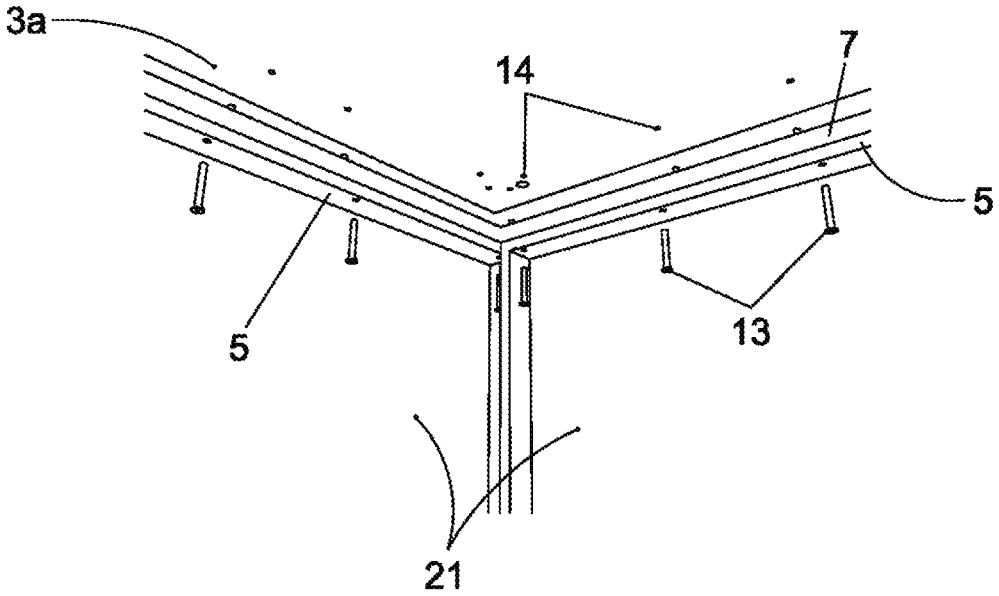
FIG. 14 shows a detail of the union between the upper line and the upper ceiling of the cabin.

In connection with the mechanical fixation means disclosed for connecting the different components of the cabin (1), they typically comprise screws (13) where at least the ceiling panels (3*a*), floor panels (4*a*), intermediate connectors (10), frames (5) and/or horizontal struts (6, 7) have holes (14) for said screws (13), which may be connected into nuts and/or bushings, not represented, provided in some of the holes (14). This is shown in FIGS. 7, 13 and 14, where centering pins (12) may also cooperate in the assembly of the panels, as seen in FIG. 12.

In order to lower the reverberation inside the cabin (1), the interior of some frames (5) of the perimeter panels—normally the simple perimeter panels (21)—may comprise a filling, not represented, of an acoustic absorbent material. Similarly, in order to improve the acoustic insulation of the cabin (1), a soundproof lining at the edges of the panels (3*a*, 4*a*, 21, 22, 23, 24, 25). Said soundproof lining comprises, at least, a felt layer (70) (see FIGS. 2 and 7).

Figure 15:
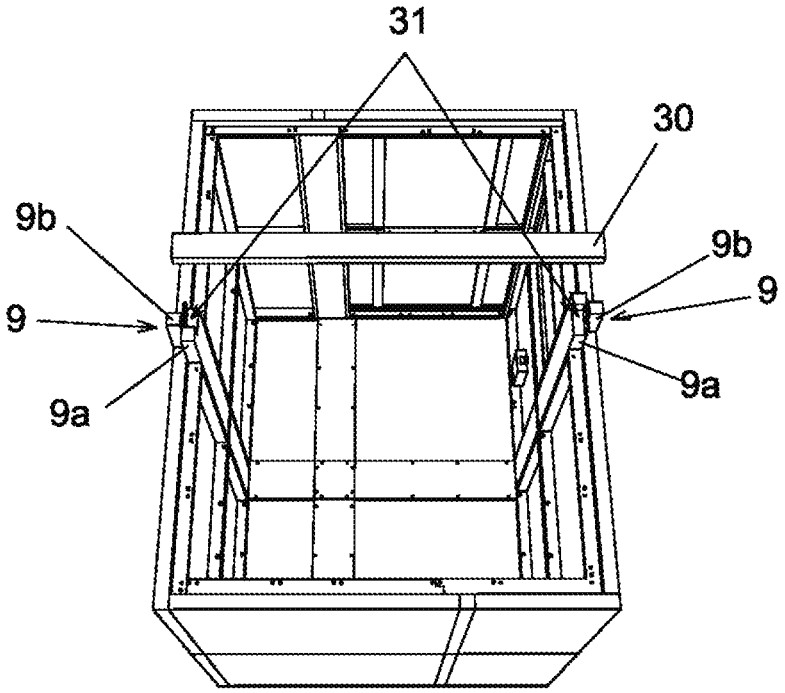
FIG. 15 shows a detail of the assembly of the upper resistant beam.

The use in the cabin (1) of the invention of, at least, an upper resistant beam (30) for the intermediate support of the upper ceiling (3) (see FIGS. 15 and 16), this allowing for the cabin (1) to be simultaneously wider and longer. Said upper resistant beam (30) may be supported on end recessed portions (31) of some of the inner square portions (9*a*) of the vertical struts (9). Further, it may comprise lights (32), as seen in FIG. 16. Alternatively, the upper resistant beam (30) may be supported by screwing at the intermediate connectors (10) of the ceiling panels (3*a*) making up the upper ceiling (3), this variation not being shown in the figures.

Figure 17:
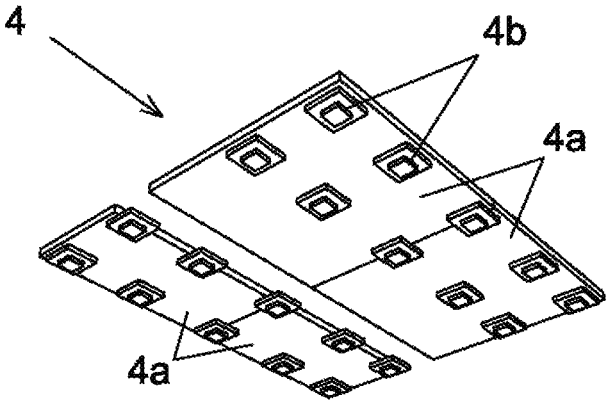
FIG. 17 shows an outside lower view of the lower floor of the cabin of the invention.

In connection with the frames (5), square portions (9*a*), struts (6, 7) and/or intermediate connectors (10), these may be made of wooden materials, such as sheets made by particles having an appropriate density, since they have good soundproof properties. Further, insulating legs (4*b*) for contacting the ground under the lower floor (4) (see FIG. 17) are also provided.

Figure 18:
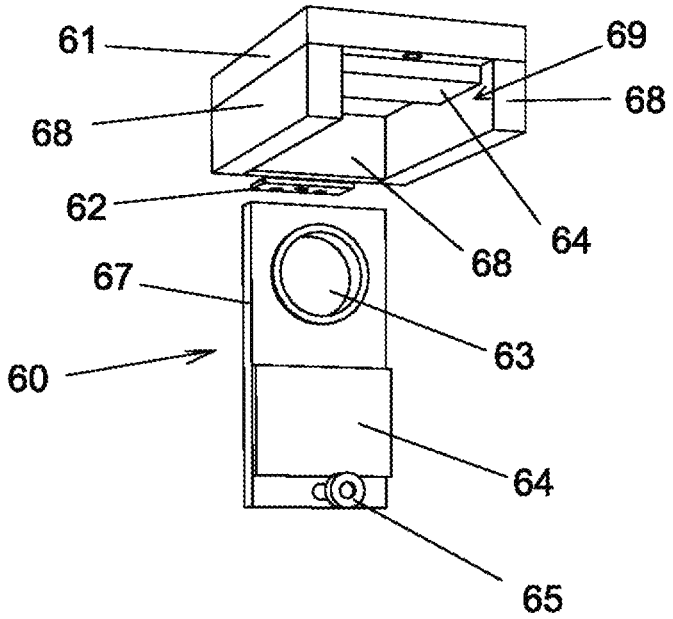
FIG. 18 shows a view of the cable lead-through of the cabin of the invention

Finally, a cable lead-through (60) is additionally provided (see FIGS. 10 and 18) which may comprise for example a base (67) connectable to any of the panels (3*a*, 4*a*, 21, 22, 23, 24, 25) and a hole (63) having a position corresponding to that of a through orifice, not represented, made in the panel it is fixed to; it further comprises a lid (61), lateral overlapping sections (68) between the base (67) and the lid (61), a lateral access (69) having a cable clamp and fixation means between the base (67) and the lid (61). The fixation means between the base (67) and the lid (61) may comprise an end hinge (62) and a pin (65) suitable for being screwed to the opposite side, said pin (65) being provided at the lateral access (69) of the cable clamp (60), and the hinge (62) at the opposite side, while the cable clamp may comprise corresponding opposite rubber plates (64) provided at the base (67) and the lid (61), and the lateral overlapping sections (68) may be connected to the outer edge of the lid (61).

Having sufficiently disclosed the invention, as well as a practical embodiment therefore, note that the features disclosed and represented in the adjacent drawings may be modified as long as those modifications do not alter the main scope.

The invention claimed is:

1. A modular soundproof cabin, comprising a perimeter wall having perimeter panels, an upper ceiling having ceiling panels and a lower floor having floor panels, wherein each of the panels have acoustic insulation properties, wherein the perimeter panels include frames located on an inner side thereof, comprising intermediate horizontal struts provided between horizontal lines of the perimeter panels, and end horizontal struts provided between a perimeter wall and the upper ceiling and the lower floor; comprising first mechanical fixation means located, at least, between the frames and the intermediate horizontal struts, and between the ceiling panels and the floor panels and the end horizontal struts, wherein each of the horizontal struts are divided into segments that comprise end dovetails, wherein each segment overlaps, at least, a connection between horizontally adjacent perimeter panels, further comprising vertical struts laterally inserted straight between the adjacent perimeter panels, wherein the vertical struts comprise a solid inner square portion and an outer soundproof portion which is recessed with respect to lateral edges of the square portion, wherein the outer soundproof portion projects up and down from the inner square portion a first length overlapping the intermediate and end horizontal struts, and wherein the perimeter panels project from the frames a second length overlapping the intermediate and end horizontal struts and the solid inner square portion.

2. The modular soundproof cabin according to claim 1, wherein the first length and the second length are equal.

3. The modular soundproof cabin according to claim 1, wherein the first length and the second length are not equal.

4. The modular soundproof cabin according to claim 1, wherein the frames have a closed frame shape.

5. The modular soundproof cabin according to claim 1, further comprising, at least, a simple perimeter panel comprising a closed vertical square configuration.

6. The modular soundproof cabin according to claim 1, further comprising, at least, a window perimeter panel comprising a hole having an acoustic insulating glass.

7. The modular soundproof cabin according to claim 1 wherein a filling of an acoustic absorbent material is provided inside a plurality of the frames.

8. The modular soundproof cabin according to claim 1 wherein all edges of the panels comprise a soundproof lining, wherein the soundproof lining comprises a felt layer.

9. The modular soundproof cabin according to claim 1 wherein the frames, square portions, struts and intermediate connectors are made of wooden materials.

10. The modular soundproof cabin according to claim 1, further comprising intermediate connectors of the ceiling panels forming the upper ceiling and the floor panels forming the lower floor, wherein the intermediate connectors comprise plates overlapping the junctions between adjacent ceiling panels or floor panels, and wherein the said intermediate connectors have second mechanical fixation means to the panels; where said intermediate connectors are provided through an interior of the end horizontal struts and have a thickness similar to that of said end horizontal struts.

11. The modular soundproof cabin according to claim 10, further comprising parts of parquet flooring made of an absorbing and resistant material provided at the gaps configured between the end horizontal strut and the intermediate connectors.

12. The modular soundproof cabin according to claim 1, further comprising, at least, an upper door panel and a lower door panel, each of said upper door panel and said lower door panel comprising a folding sector hinged at one side of said upper door panel and said lower door panel to the rest of the respective panel, and comprising third mechanical fixation means between both folding sectors, wherein the third mechanical fixation means between both folding sectors are implemented between adjacent flanges of both folding sectors.

13. The modular soundproof cabin according to claim 12, wherein the overlapping of the folding sectors in the rest of the respective panel is carried out by means of oblique lateral edges.

14. The modular soundproof cabin according to claim 1 further comprising, at least, an upper resistant beam for providing intermediate support to the upper ceiling, wherein the upper resistant beam is supported on end recessed portions provided in two inner square portions of two vertical struts.

15. The modular soundproof cabin according to claim 14, wherein the upper resistant beam is supported by screwing to intermediate connectors of the ceiling panels forming the upper ceiling.

16. The modular soundproof cabin according to claim 1 further comprising, at least, a cable lead-through comprising a base connectable to any of the panels and having a hole in a position corresponding to a through orifice made therein, comprising a lid, lateral overlapping portions between the base and the lid, a lateral access having a cable clamp and fixation means between the base and the lid.

17. The modular soundproof cabin according to claim 16, wherein the fixation means between the base and the lid comprise an end hinge and a pin which is screwed to the opposite end, said pin being located at the lateral access of the cable lead-through, and the hinge being located at the opposite side.

18. The modular soundproof cabin according to claim 1, further comprising, at least, a ventilation perimeter panel comprising a ventilation through hole and a silencer box, wherein the silencer box is adapted to be inserted in the frame of the ventilation perimeter panel.

19. The modular soundproof cabin according to claim 18, wherein an air blower is connected at the outside of the hole by means of a soundproof duct, wherein the air blower comprises a soundproof cover.

20. The modular soundproof cabin according to claim 18, wherein the silencer box comprises a first terminal connected to the hole and a second free terminal accessing the inside of the cabin.

21. The modular soundproof cabin according to claim 20, wherein the silencer box comprises a first terminal connected to the hole and a second free terminal accessing the inside of the cabin.

* * * * *